US005108038A

United States Patent [19]

Palladino et al.

[11] Patent Number: 5,108,038

[45] Date of Patent: Apr. 28, 1992

[54] MATERIAL SPREADER FOR CONVEYOR-TYPE HOPPER BODY

[76] Inventors: John M. Palladino, 2106 Cemetery Rd., Fabius, N.Y. 13063; Wesley A. Rosenberg, R.D. 2, Box 211A, Tully, N.Y. 13159

[21] Appl. No.: 568,783

[22] Filed: Aug. 17, 1990

[51] Int. Cl.[5] ..... A01C 19/00

[52] U.S. Cl. ..... 239/661; 222/56; 222/64; 222/609; 222/626; 222/273; 222/278; 239/664

[58] Field of Search ..... 222/609, 610, 622-627, 222/252, 272-274, 278, 330, 415, 412, 56, 64; 239/661, 664, 675, 676

[56] References Cited

U.S. PATENT DOCUMENTS

| | | | |
|---|---|---|---|
| 750,463 | 1/1904 | Kessler | 239/664 |
| 2,500,681 | 3/1950 | Hoffstetter | 239/664 |
| 2,511,514 | 6/1950 | Rosselot | 239/664 |
| 2,743,932 | 5/1956 | Wester | 239/664 |
| 3,029,714 | 4/1962 | Creswell | 239/664 X |
| 3,253,745 | 5/1966 | Skelton | 222/56 |
| 3,559,893 | 2/1971 | Gruben | 239/664 |
| 3,756,509 | 9/1973 | Hamnes | 239/664 X |
| 4,212,428 | 7/1980 | Walker | 222/622 X |
| 4,884,724 | 12/1989 | Schmidt | 222/623 |

*Primary Examiner*—Kevin P. Shaver
*Attorney, Agent, or Firm*—Wall and Roehrig

[57] ABSTRACT

An elongated particulate material spreader hopper is provided for detachable mounting on the back end of a conventional sand/salt hopper truck to allow its use in summer for spreading of gravel and other particulate material in road building and resurfacing applications. Hydraulically powered screw conveyors are provided to distribute the material evenly across the full width of the spreader approximating a driving lane on a major highway. Doors or gates are provided to control the amount and width of the discharge of particulate material to the highway surface.

5 Claims, 4 Drawing Sheets

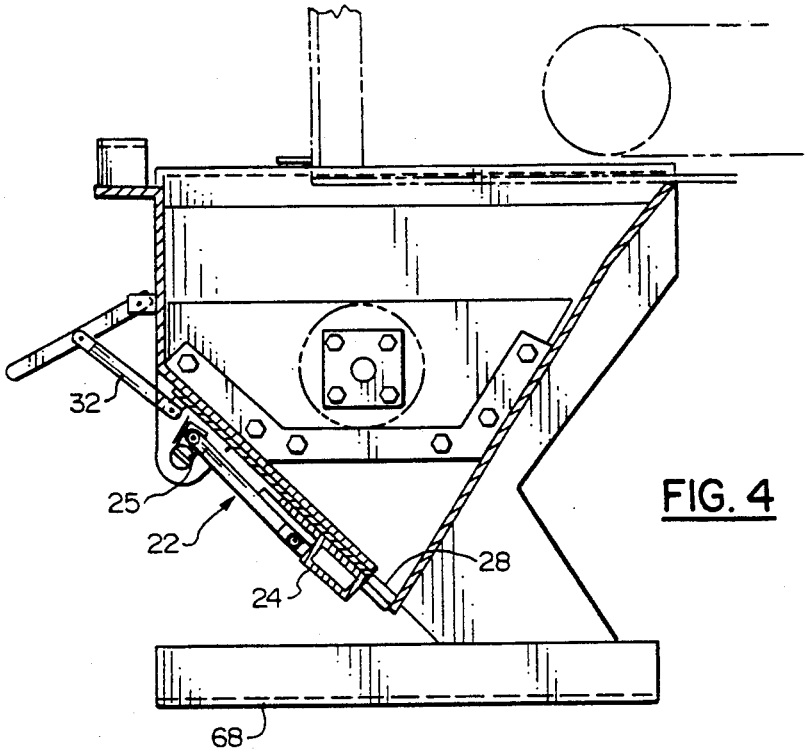
FIG. 4
FIG. 8
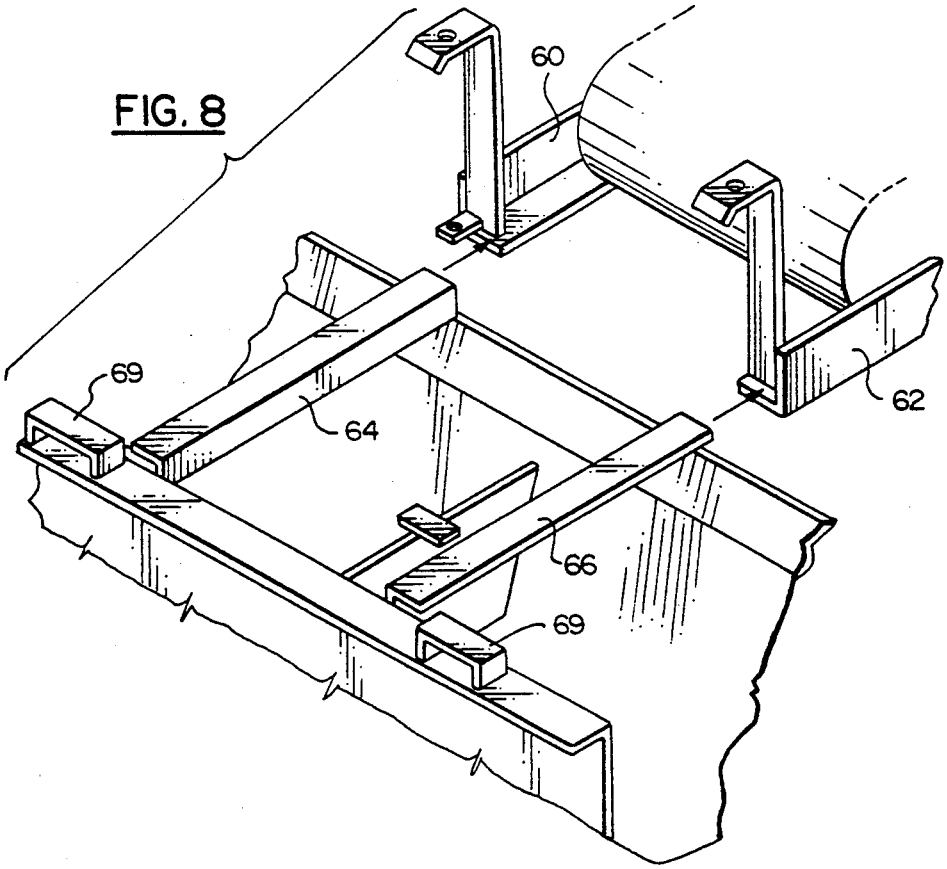

MATERIAL SPREADER FOR CONVEYOR-TYPE HOPPER BODY

BACKGROUND OF THE INVENTION

This invention relates to a material spreader and more particularly to an elongated spreader hopper adapted to be mounted at the rear of a hopper truck to receive particulate material therefrom and spread it on a surface evenly throughout the width of the truck.

For many years now in northern climates where spreading of sand, salt, and the like on highways is a common winter time occurrence, specialized hopper trucks have been developed. These trucks have a large sloped hopper for receiving the sand/salt and a conveyor, usually a belt type, in the bottom of the hopper for conveying the sand/salt to the back of the truck where it is discharged onto a rotating disc which throws the sand/salt across the width of the road as the truck is driven down the road.

Because of the rather specialized nature of these hopper trucks and their particular construction characteristics they have been a single purpose machine and have had to sit idle for the better part of the year, when not employed in their primary function of spreading sand and salt.

In the better weather parts of the year, road building activities particularly resurfacing activities, require the spreading of gravel in an even and controlled manner along the road surface. These large specialized hopper trucks have the ability to deliver large quantities of gravel but the conventional rotating disc hopper has proven very unsatisfactory for the even controlled distribution of material as required in road building.

OBJECTS OF THE INVENTION

Accordingly, it is an object of the present invention to provide a material spreader that overcomes the limitations of the prior art.

It is another object of the present invention to provide a material spreader for detachable mounting on the rear of a hopper truck designed for spreading salt and sand that is adapted to spread and distribute a uniform layer of gravel or similar particulate material across a given width of roadway for road building and resurfacing purposes.

It is another object of the present invention to provide a particulate material spreader for depositing a quantity of particulate material in a uniform layer along a roadway over a selected width.

It is another object of the present invention to provide an elongated spreader hopper for detachable mounting on the rear of a sand hopper truck in place of the usual disc spreader for permitting a uniform, controlled spreading of a layer of particulate material on a roadway.

In a preferred embodiment of the present invention this is accomplished by an elongated hopper box detachably mounted on the back of the truck and having a v-shaped hopper bottom, with screw conveyors positioned therein, to distribute the particulate material deposited at the center of the box uniformly throughout the length of the box. Adjustable doors or gates are provided for controlling the deposition of material at selected intervals and throughout the entire width of the hopper box.

BRIEF DESCRIPTION OF THE DRAWINGS

These and other and further objects of the invention together with additional features and advantages occurring therefrom will be apparent from the following description of a preferred embodiment of the present invention shown in the accompanying Drawings in which:

FIG. 4 is a sectional view taken on line 4—4 of FIG. 3;

FIG. 8 is a partial perspective view of the mounting brackets for positioning the hopper of the present invention on the usual sand hopper truck currently widely utilized;

DETAILED DESCRIPTION OF THE PREFERRED EMBODIMENT

Figure 1:
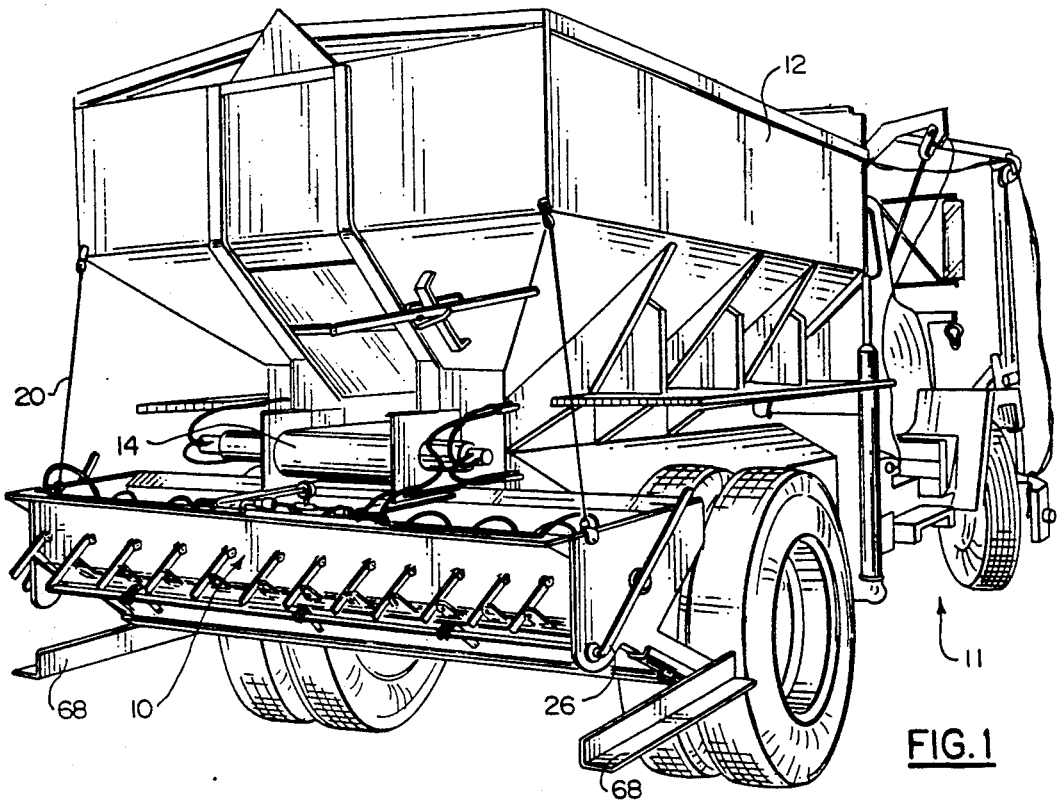
FIG. 1 is a perspective view of the rear of a hopper truck of the type to which this invention applies.

Referring now to FIG. 1 the material spreader 10 is shown mounted on the rear of a hopper truck 11 of the type commonly used to spread salt and/or sand on highways and which has a large sloped hopper body 12 with a conveyor belt 14 along the bottom of the load bed of the hopper 12 adapted to transfer sand or salt from within the hopper to the rear of the truck where it is generally discharged into a rotary disc hopper spreader for spreading of the material across the highway. The conveyor belt 14 is driven by one or more hydraulic motors 16 in the conventional manner as is well known in the art. The distribution hopper 10 extending across the full width of the back of the truck is an elongated rectangular box having a hopper bottom as may be seen better in FIG. 4. The distribution hopper box 10 is mounted on the back of the truck body 11 in place of the usual conventional disc spreader as will be described in detail herein. The hopper 10 is positioned so as to receive material transported by the belt 14 as it is discharged into the center of the elongated distribution hopper 10. This can be seen clearly in FIGS. 2, 3, and 5.

The hopper box 10 has a generally rectangular cross section with a v-shaped bottom adapted to cause sand or particulate matter such as gravel to flow towards the bottom and to be discharged through a slot that is controlled by a mechanism 22 shown in section in FIG. 4. The mechanism 22 consists of a plate 24 slidably mounted on box 10 to form both the rear bottom surface of the hopper v-shaped bottom and a door or gate for the discharge slot 28. Plate 24 is controlled by a series of levers connected through shaft 25 to handle 26 located at either end thereof. Movement of handle 28 will cause plate 24 to open and close the discharge slot 28 in the bottom of the hopper 10 as best seen in FIG. 4.

Figure 2:
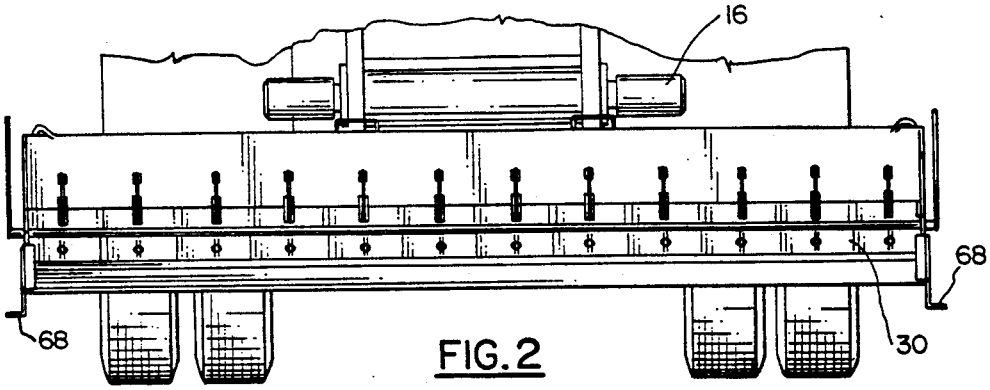
FIG. 2 is a rear elevation of the hopper mechanism of the present invention.

The plate 24 extends all the way across the width of the hopper and is used to control the rate of flow of particulate material through the hopper on to the pavement. In addition, as may be seen in FIGS. 1–4, there are provided a plurality of individual gates 30 each controlled by a lever 32 and adapted to be opened or closed selectively to shut off the discharge slot 28 at a particular location. As shown in FIG. 2 the width of the hopper is divide into 12 individual hopper doors 30 any one of which can be lowered to shut off or restrict the flow of gravel at that point. It is thus obvious that the width of discharge can be varied as well as spacing of the discharge relative to the center line of the truck by adjusting the individual gates 30 actuated by levers 32. The overall rate through the gap 28 can, of course, still be controlled by movement of the bar or plate 24 via handles 26.

Figure 3:
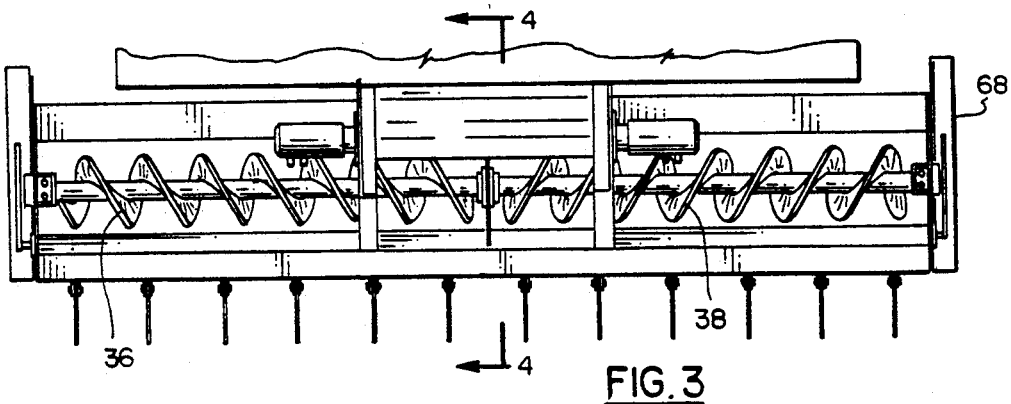
FIG. 3 is a top plan view of the spreader hopper of the present invention.
Figure 5:
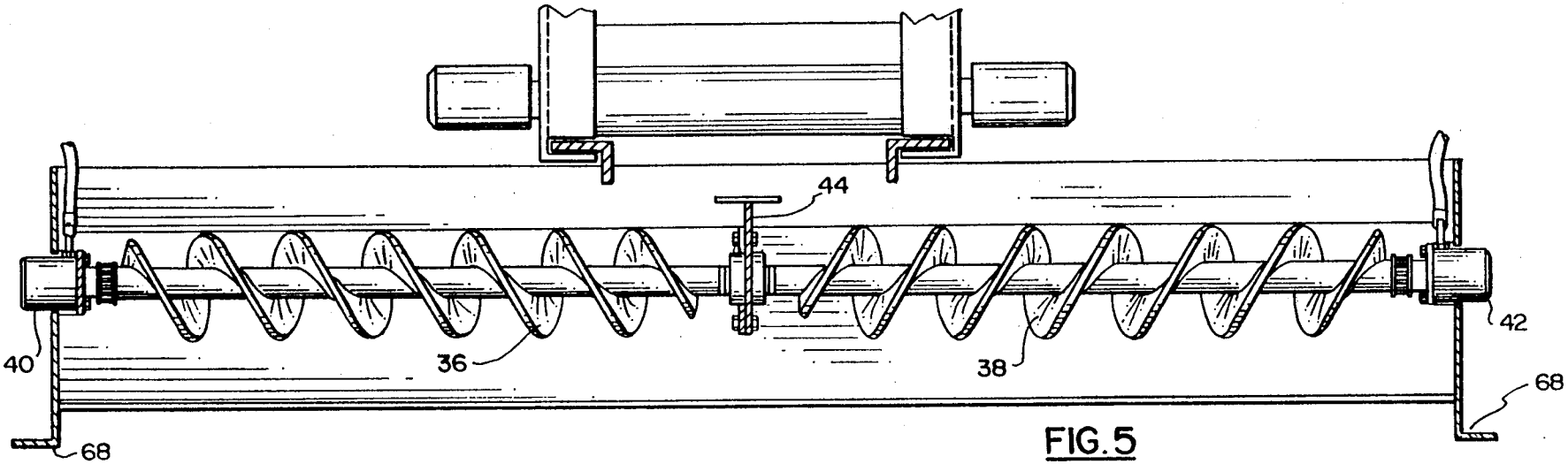
FIG. 5 is a top plan view with parts broken away to show the screw conveyor mechanism.
Figure 7:
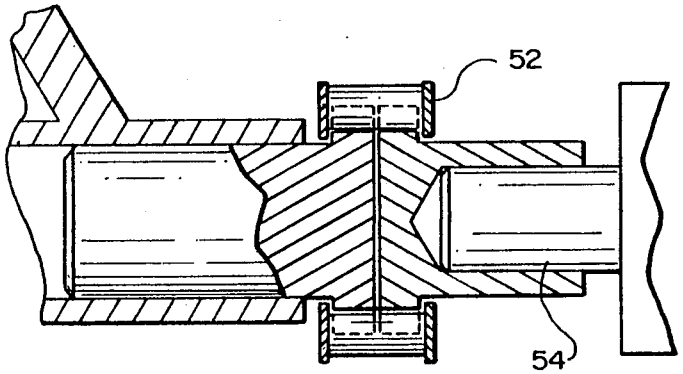
FIGS. 6 and 7 are large scale partial sectional views of the mounting details of the end of the screw conveyors of FIG. 5.
Figure 6:
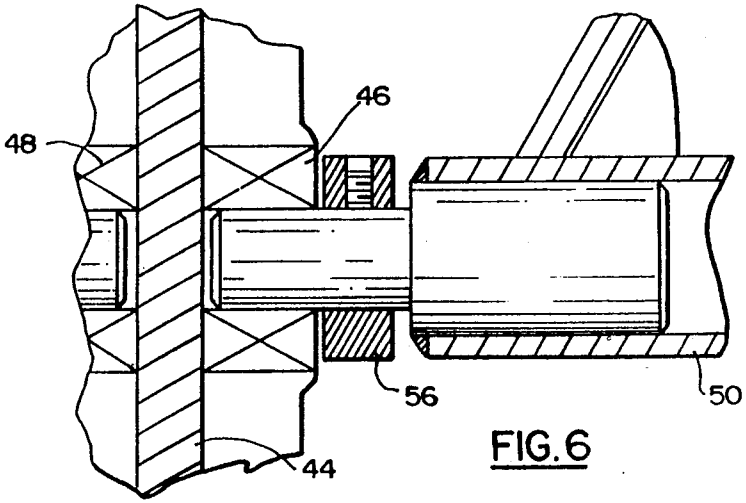

As shown in FIGS. 3, 4, and 5 there is mounted within the hopper 10 a pair of screw conveyors 36 and 38 which are configured so as to spread particulate material deposited at the center of the hopper outwardly towards the ends thereof in a uniform fashion as well known in the industry. Each screw conveyor 36 and 38 is driven by a hydraulic motor 40 and 42. As can be seen in FIGS. 3 and 5 the conveyors 36 and 38 have left and right hand augers respectively so that material dumped into the hopper from the belt 14 is divided between the two conveyors with approximately half the material being spread to the left and half to the right as shown in FIG. 5. The gravel is distributed throughout the width of the hopper and allowed to be discharged to the road surface in a uniform evenly distributed fashion.

The screw conveyors 36 and 38 are fixed about hollow shafts 50. The shafts 50 are carried on the inboard ends by bearings 46 & 48 and at the outboard by the hydraulic motors 40 & 42. The outboard end of shafts 50 are connected by coupling 52 to a stub shaft 54 mounted on the output shaft of the hydraulic motors. A thrust collar 56 is provided for longitudinal adjustments of the screw conveyors.

Referring now to FIG. 8 there is shown the mounting arrangement for positioning the hopper 10 on the center of the rear of the hopper truck shown in FIG. 1. In the ordinary sand hopper truck installation the disc spreader and its associated hopper are mounted in slots in a pair of angle irons mounted on the frame of the truck. These are shown as 60 and 62 in FIG. 8 and have horizontal legs and vertical legs with the horizontal legs forming a shelf to receive a corresponding inverted pair of angles 64 and 66 fixed across the top of the hopper assembly. The angles 64 and 66 are welded to the frame of the hopper 10 and spaced apart a distance correspondingly to the spacing between the angles 60 and 62 mounted on the rear of the truck.

In use the disc spreader assembly from the truck is removed and the hopper spreader is mounted by sliding the angles 64 and 66 into the slots formed with angles 60 and 62 so as to support and position the center of the hopper assembly 10 in the proper location on the rear of the truck. The support bars 20 at each end of the hopper are then connected to the body of the truck hopper to stabilize and support the extended narrow rectangular hopper 10 in its proper mounting position on the truck. In this position the conveyor belt 16 can readily convey particulate material from the hopper 12 into the hopper 10 for distribution across its width and for later discharge onto the roadway surface.

A pair of feet 68 are provided at the ends of the hopper box to support the box in an upright position when placed on the ground. A pair of lifting channels or loops 69 are provided on the upper edge of the frame to assist in mounting the hopper 10 on the truck 11. The forks of a lift truck can be inserted into the channels 69 and the box lifted up and inserted in the slots formed with the angles 60 & 62.

In the operation of the material hopper 10 it is essential to keep the distribution of the particulate material as uniform as possible and to maintain control over its delivery to the slot 28 and ultimately its discharge onto the road surface. It is necessary in road building and resurfacing applications to apply the stone or gravel as the case may be in as even and uniform a layer as possible. Application of too much stone becomes wasteful and expensive and application of an insufficient amount of stone results in an inferior product and perhaps a dangerous road surface condition.

Figure 9:
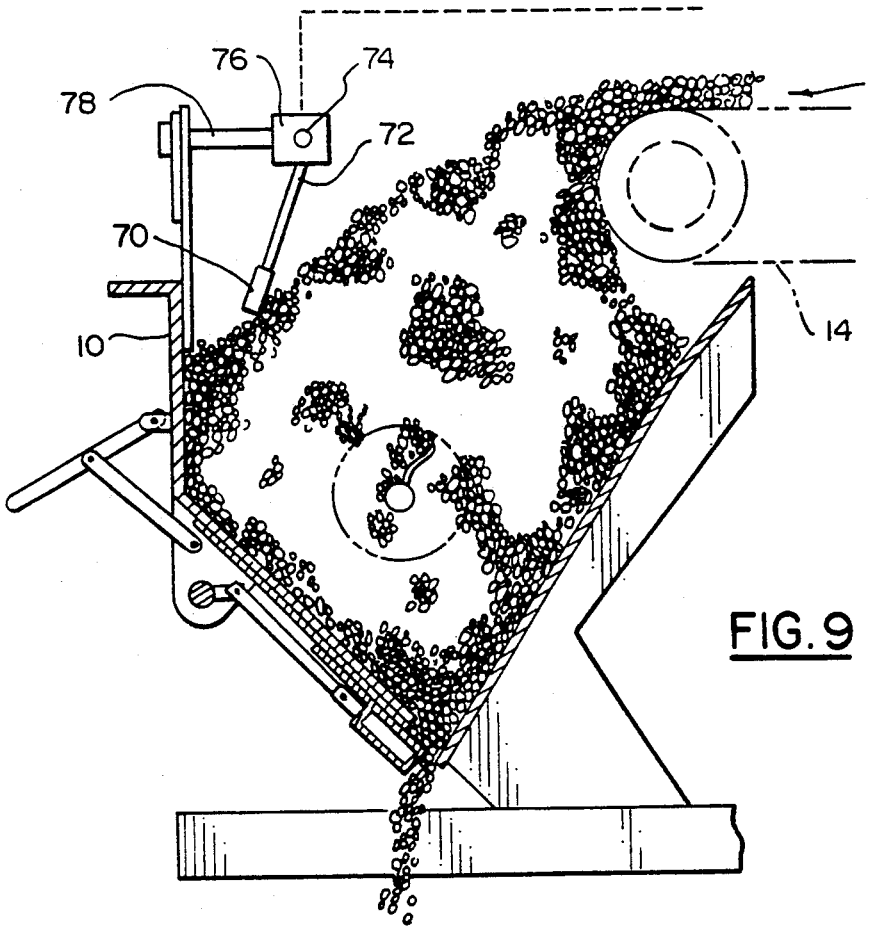
FIG. 9 is a view similar to FIG. 4 showing the conveyor belt level control.

As may be see in FIG. 9, as one of the control system there is provided a paddle 70 fixed on an arm 72 which is pivoted about a shaft 74 so as to actuate a microswitch 76 when it moves from the empty to the full position. As can be seen in FIG. 9 the paddle moves basically from an extended position toward the front of the truck to a rearward position in which it actuates the microswitch 76. The shaft 74 is mounted on a frame member 78 which is adjustably secured to the back frame of the hopper 10 for vertical adjustment up and down to control the depth of material deposited in the hopper 10 by the belt 14. In operation as the belt delivers material to the screw conveyors 36 and 38 the material will be uniformly fed towards the outer ends of the hopper 10 and discharged through the opening 28 at the proper rate on the road surface being worked on. If for any reason the belt 14 gets ahead of the spreading operation then the level of the particulate material at the center of the hopper 10 will build up and push the paddle 70 rearwards towards the back of the hopper which in turn actuates the microswitch 76 to turn off the hydraulic fluid flowing to the motors 16 driving the belt 14. As the screw conveyor 36 and 38 catch up and the material is moved out sufficiently the paddle 70 will move to its forward position and turn on the hydraulic motors 16 for driving the belt 14.

Figure 10:
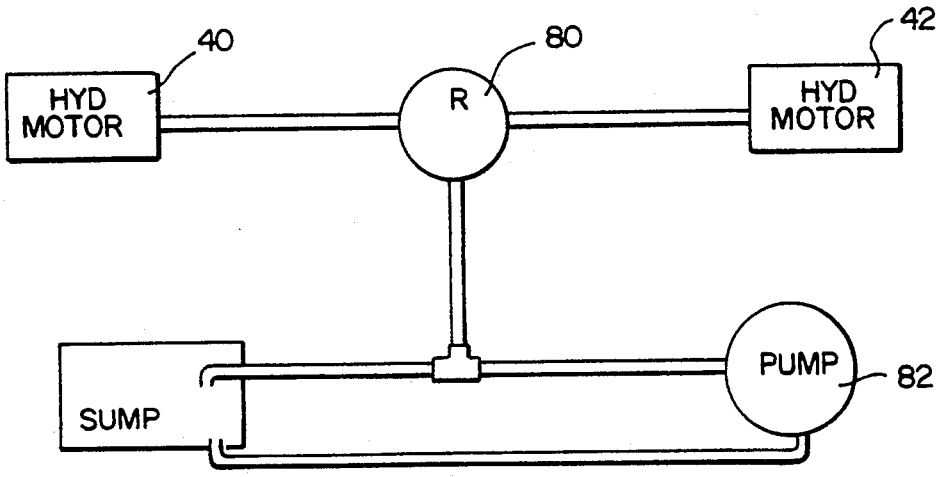
FIG. 10 is a hydraulic schematic diagram showing the control system for preventing overloading of one side or the other of the hopper box.

An additional safety feature of the control system is a pressure relief valve 80 shown in FIG. 10 which controls the hydraulic motors 40 and 42 to prevent over filing of one side or the other of the hopper 10 and also to protect the motors and structure from over stress due to improper loading of material therein. Generally speaking the hydraulic system consists of a pump 82 which is usually configured in a recirculating arrangement typical in the art so that when a given pressure has been exceeded it merely recirculates the hydraulic fluid back through the pump. The pump generally is set for pressure of about 2000 psi and is fed to the pressure relief valve 80 and then to the hydraulic motors 40 and 42. The pressure relief valve 80 is set such that if the pressure in the system to either motor exceeds a preset value, such as 1200 psi, the relief valve will shut off hydraulic pressure and fluid flow to that particular motor stoping rotation of the corresponding screw conveyor. Frequently when working on an incline or for other reasons an excessive amount of material may be deposited in one side or the other of the elongated hopper 10 and it will begin to over burden that side of the screw conveyor and hopper. Also occasionally a conveyor may become jammed. Accordingly, by shutting down the screw conveyor, until the problem is cleared, damage to the machine is prevented, a potentially unsafe condition corrected and the quality of the road surface is maintained. As the load or obstruction is cleared the pressure relief valve will reopen and allow hydraulic fluid to once again rotate the screw conveyor in question.

It should be noted that if both sides of the screw conveyors exceed the preset pressure then the pressure relief valve will shut down entirely and the hydraulic fluid will merely be recirculated around through the sump and back to the pump as is well known in the art.

The control of the level of a particulate material being dumped into the hopper and the sensing of the hydraulic loads in the left and right hand sides of the hopper allow the safe and efficient operation of the spreader without overloading the apparatus so as to endanger a workman in the vicinity or to upset the uniform distribution of particulate material, i.e. gravel onto the road surface at the desired uniform specified thickness.

We have thus provided a device for utilizing the normally idle sand hopper truck to apply gravel or other particulate materials to road surfaces in a uniform layer so as to make the truck useable for road building and resurfacing applications which heretofore had to be handled by dump trucks and similar type of vehicles.

While we have shown and described a particular embodiment, with respect to selected preferred embodiments, it should be understood that the invention is not limited to those precise embodiments. Rather, many modifications and variations would present themselves to those in the art without departure from the scope and spirit of this invention, as defined in the appended claims.

What is claimed is:

1. In a truck having a conveyor in the bottom of the load bed of the type used to dispense particulate material over a road surface, a lateral spreader attachment for spreading particulate material over substantially the full width of a road traffic lane comprising;

a narrow elongated hopper box adapted to be detachably mounted across the back of a truck;

said hopper box being positioned to receive at the center thereof particulate material from a conveyor in said truck;

conveyor means mounted along the length of said hopper box for transporting particulate material received in the center of said hopper box outwardly to the ends thereof;

motor means for operating said conveyor means;

hopper door means mounted along the length of said hopper box to form a discharge aperture along the bottom thereof;

means for selectively opening and closing said hopper door means to control the amount of particulate material being dispensed from said hopper;

means for mounting said hopper box on a truck in place of a disk spreader apparatus comprising a pair of right angle frame members, having a vertical and a horizontal leg, mounted transversely of said elongated hopper box on either side of the center line thereof, with the horizontal leg of said angles facing toward the ends of said box; and said angles being spaced apart a distance corresponding to the distance between a pair of mating angles mounted on the truck.

2. A spreader attachment according to claim 1 further including a pair of lifting channels mounted adjacent the right angle members for lifting the hopper box into mounting position;

a support rod fixed at each end of said hopper box adapted to engage the truck body to support the ends of said hopper box; and a pair of horizontal leg member for supporting said hopper box in an upright position when detached and placed on the ground.

3. In a hopper truck having a conveyor in the bottom of the hopper load bed of the type used to dispense particulate material over a road surface, a lateral spreader attachment for spreading particulate material over substantially the full width of a road traffic lane comprising:

a narrow elongated box adapted to be detachably mounted across the back of a truck;

said elongated box being positioned to receive at the center thereof particulate material from the conveyor in the truck;

left and right conveyor means mounted along the length of said elongated box for transporting particulate material received in the center of said elongated box outwardly to the ends thereof;

individual motor means for actuating said left and right conveyor means;

hopper door means mounted along the length of said elongated box to form a discharge aperture along the bottom thereof;

means for selectively mounting said elongated box on a hopper truck including first frame means mounted on said truck, second frame means mounted on said box, said first and second frame means being cooperatively formed with each other for mating assembly; and control means for said individual motor means including overload sensing means for automatically selectively shutting off one or both of said individual motor means upon filling of the corresponding side of said narrow elongated box.

4. A spreader attachment according to claim 3 wherein said individual motor means comprises a hydraulic motor mounted at each outboard end of said hopper box operatively connected to said left and right conveyor means for operation thereof; and said overload sensing means includes a pressure relief means in the hydraulic fluid supply line to said hydraulic motors so that when the load on an individual hydraulic motor exceeds a preselected amount, hydraulic fluid is shut off from that motor.

5. In a specialized hopper truck having a large sloped hopper for sand/salt and a belt conveyor in the bottom of the hopper for conveying sand/salt to the back of the truck for discharge into a spreader hopper;

a narrow elongated spreader box having a generally rectangular cross section with a sloped hopper bottom;

an elongated hopper door extending across the full width of the box along the bottom of the hopper to form a part of the bottom thereof;

said door being slidably mounted on said box for selective opening and closing of a discharge slot along the width of said hopper bottom;

a plurality of secondary hopper door members slidably mounted in side by side relation and parallel with said hopper door for selectively closing off a portion of the discharge slot formed when said hopper door is open;

means for detachably mounting said hopper box across the rear of a sand/salt hopper truck;

first and second screw conveyor members rotatably mounted adjacent the bottom of said sloped hopper bottom;

a hydraulic motor operatively connected to each of said first and second screw conveyor members; and control means for applying hydraulic fluid to said motors for rotating said screw conveyors, for regulating the operation of the belt conveyors in the hopper truck, and for shutting off hydraulic fluid to said motors when the hydraulic pressure exceeds a predetermined valve;

so that particulate material placed in the hopper truck may be spread in a uniform layer on a road surface over a predetermined path width.

* * * * *